US011618174B2

(12) United States Patent
Kao

(10) Patent No.: US 11,618,174 B2
(45) Date of Patent: Apr. 4, 2023

(54) KNIFE ALLOWING RAPID AND SAFE REPLACEMENT AND SECUREMENT OF BLADE, AND CONNECTING BASE THEREOF

(71) Applicant: Chih-Chen Kao, Taoyuan (TW)

(72) Inventor: Chih-Chen Kao, Taoyuan (TW)

( * ) Notice: Subject to any disclaimer, the term of this patent is extended or adjusted under 35 U.S.C. 154(b) by 53 days.

(21) Appl. No.: 17/353,817

(22) Filed: Jun. 22, 2021

(65) Prior Publication Data

US 2022/0339805 A1 Oct. 27, 2022

(30) Foreign Application Priority Data

Apr. 22, 2021 (TW) ..... 110114610

(51) Int. Cl.
*B26B 1/04* (2006.01)
*B26B 5/00* (2006.01)

(52) U.S. Cl.
CPC . *B26B 1/04* (2013.01); *B26B 5/00* (2013.01)

(58) Field of Classification Search
CPC ..... B26B 1/04; B26B 1/046; B26B 5/00
See application file for complete search history.

(56) References Cited

U.S. PATENT DOCUMENTS 6,446,341 B1 * 9/2002 Wang ..... B26B 5/00 30/155
8,966,769 B1 * 3/2015 Mollick ..... B26B 1/046 30/164
9,687,987 B2 6/2017 Bloch
11,123,884 B1 * 9/2021 Mollick ..... B26B 1/048
2007/0186420 A1 * 8/2007 Koelewyn ..... B26B 1/048 30/153
2013/0212886 A1 * 8/2013 Hawk ..... B26B 1/02 30/155
2015/0217461 A1 * 8/2015 Langenwalter ..... B26B 11/00 7/118
2016/0271809 A1 9/2016 Bloch
2017/0203447 A1 * 7/2017 Hinderer ..... B26B 11/00
2017/0266821 A1 9/2017 Cheng
2019/0375118 A1 * 12/2019 Spotora ..... B26B 1/046
2020/0086510 A1 * 3/2020 Bessac ..... B26B 1/10
2021/0197411 A1 * 7/2021 Demko ..... B26B 9/00
(Continued)

FOREIGN PATENT DOCUMENTS

TW M518152 U 3/2016
TW 202042991 A 12/2020

*Primary Examiner* — Omar Flores Sanchez
(74) *Attorney, Agent, or Firm* — CIPO IP Group

(57) ABSTRACT

A knife allowing rapid and safe replacement and securement of a blade which can be fixed to a front end of a connecting base of the knife. The connecting base has a rear end that can be connected to a handle, and includes an upper base body, a lower base body, a lock-release member, and a spacer plate that can be located between the upper and lower base bodies and form an engaged-connection groove along with the base bodies therebetween. The engaged-connection groove matches, and enables the insertion therein and engagement therewith, a portion of the blade at or adjacent to the rear end thereof. The lock-release member can be arranged on the connecting base for a user to set the blade into a locked state, in which the blade is securely positioned and cannot be detached, or an unlocked state, in which the blade can be detached.

11 Claims, 9 Drawing Sheets

(56) References Cited

U.S. PATENT DOCUMENTS

| | | | | |
|---|---|---|---|---|
| 2021/0299892 | A1* | 9/2021 | Chen | B26B 1/04 |
| 2021/0354318 | A1* | 11/2021 | Scimone | B26B 1/04 |
| 2022/0126462 | A1* | 4/2022 | McKay | B26B 1/044 |

* cited by examiner

KNIFE ALLOWING RAPID AND SAFE REPLACEMENT AND SECUREMENT OF BLADE, AND CONNECTING BASE THEREOF

CROSS-REFERENCE TO RELATED PATENT APPLICATION

This non-provisional application claims priority to and the benefit of, under 35 U.S.C. § 119(a), Taiwan Patent Application No. 110114610, filed in Taiwan on Apr. 22, 2021. The entire content of the above identified application is incorporated herein by reference.

FIELD

The present disclosure relates to a knife, and more particularly to a knife that allows a blade (e.g., a knife blade, saw blade, or other tool plate capable of cutting) already engaged with and secured on the connecting base of the knife to be rendered into an unlocked, and hence detachable, state by the user pressing the lock-release button on the connecting base with a finger (e.g., the thumb or index finger) of the hand in which the handle of the knife is held (e.g., the right hand); that allows the blade to be subsequently removed from the connecting base in a rapid and safe manner by the user gripping the blade from two lateral sides respectively with two fingers (e.g., the thumb and the index finger) of the other hand (also referred to as the second hand, e.g., the left hand) and pulling the blade forward with the same two fingers; and that allows a new blade to be rapidly and safely put in place and secured at the front end of the connecting base by the user gripping the new blade from two lateral sides respectively with two fingers (e.g., the thumb and the index finger) of the second hand (e.g., the left hand) and inserting a portion of the new blade that is at or adjacent to the rear end of the new blade into the connecting base so that the user can use and maneuver the new blade safely, steadily, and precisely while holding the handle.

BACKGROUND

Recently, with the continual advancement of technology and the gradual improvement in the quality of life, one who intends to buy a new product would consider not only the appearance and price of the product, but also the case of use, durability, and safety of the product in order to determine whether the product should be bought. This change in market trends has driven manufacturers in each and every industry to continue their innovation, research, and development efforts so as to produce more advanced products that will hopefully meet the aforesaid requirements of most consumers.

Take knives for example. In order for knives to be used and maneuvered in a safe, effortless, and precise manner, different types of cutting edges have been designed for different user needs and usage scenarios, the objective being to satisfy the demand for a diversity of uses. In the market of conventional knives, the cutting edges of blades can be divided by configuration into two major types: plain edges and serrated edges. A plain edge is a smooth cutting edge and can carry out more precise cutting than a serrated one. A serrated edge is a sawlike cutting edge, has a larger area of contact in a cutting operation than a plain edge, and is more labor-saving during use than a plain edge. In short, each type of cutting edge has its own advantages and disadvantages. To combine the advantageous features of both types, a partly serrated edge, or combo edge, was developed. As the name "partly serrated edge" suggests, a portion of a partly serrated edge has a plain-edge configuration while the remaining portion has a serrated-edge configuration, wherein the design locations of, and the ratio between, the plain-edge portion and the serrated-edge portion can be adjusted according to market needs. However, since the plain-edge portion and the serrated-edge portion make up the entirety of the partly serrated edge, neither portion extends to the full length of the partly serrated edge; in other words, neither portion will exhibit the advantageous features of a full-length plain edge or a full-length serrated edge. A partly serrated edge, therefore, still causes inconvenience in use.

As stated above, different types of cutting edges have their respective pros and cons, and a knife with a partly serrated edge is not a complete substitute for a knife with a full-length plain or serrated edge. Consequently, a knife user still has to carry several knives with them in anticipation, and in order to meet the requirements, of different usage scenarios. The plurality of knives, however, must add to the user's purchase cost and cause difficulties in maintenance and carry. Furthermore, it is a long-standing practice in the knife market to provide each knife with a cutting edge of fixed specifications. As a result, a knife whose cutting edge is worn after long-term use cannot have its blade replaced alone and must be discarded as a whole, which in turn requires a new knife to be bought. Nevertheless, replacing an entire knife with a new one causes not only additional expense but also a wasteful use of resources. In view of this, knives with a replaceable blade were proposed as a solution to the perennial problem that a knife can neither have different types of cutting edges nor have its blade replaced.

The conventional scalpels used in the medical field are based on the structural concept of "having a blade replaceable with different types of blades". Referring to FIG. 1, a conventional scalpel 10 includes a blade 11 and a handle 12. The blade 11 is formed with an engaging slot 110 that extends in the longitudinal direction of the blade 11. The front end of the handle 12 is extended, or protrudingly provided, with an engaging portion 121, and the periphery of the engaging portion 121 is concavely provided with a groove 122 adjacent to the front end of the engaging portion 121. To put the blade 11 and the handle 12 together, it is required that the user grips the blade 11 and the handle 12 with two hands respectively, align the engaging slot 110 of the blade 11 with the groove 122, and then pushes the blade 11 toward the handle 12 (as indicated by the arrow) until the rear end 111 of the blade 11 is pressed against and deformed by a position-limiting portion 123 of the handle 12 and the two engaging portions 113 located in a front section of the blade 11 and corresponding respectively to two opposite lateral sides of the engaging slot 110 are engaged in the groove 122. The operation described above allows the blade 11 and the handle 12 to be securely coupled as a single unit. When it is desired to take the blade 11 off the handle 12, the user must hold the handle 12 with one hand, grip the blade 11 at a position adjacent to the front end 112 of the blade 11 with the other hand (also referred to as the second hand), and apply through the second hand to the blade 11 a force large enough to deform, or more specifically twist, the blade 11 so as to push the rear end 111 of the blade 11 to a position as high as the top surface of the engaging portion 121, thereby bringing the engaging portions 113 out of engagement with the groove 122. Only then can the user remove the blade 11 from the handle 12 by pulling the portion of the blade 11 that is adjacent to the front end 112 with the second hand. While the scalpel 10 has the "replaceable" blade 11, convenience of use is not ensured; the user must use both hands and cannot mount the blade 11 to the handle 12 or detach the blade 11 from the handle 11 unless one of the user's hands is used to grip a portion of the blade 11 that is adjacent to the front end 112 and apply to the blade 11 a force large enough to deform, or twist, the blade 11. As the portion of the blade 11 that is adjacent to the front end 112 does not provide large gripping areas, and the cutting edge of the blade 11 is extremely sharp, it is quite frightening, if not unsafe, to mount the blade 11 to the handle 12 or detach the blade 11 from the handle 12 by deforming, or twisting, the blade 11. This explains why most users are always unable to mount or detach the blade 11 easily, effortlessly, and safely.

Years ago, a knife structure 7 with a replaceable blade was designed by incorporating the structural concept of "replaceability" of the conventional scalpel 10 into a general knife. Referring to FIG. 2, the knife structure 7 with a replaceable blade includes a blade 71, a handle 72, an engaging and positioning base 73, and a pushing plate 74. The front end of the blade 71 forms a blade tip 710. A first engaging slot 711 and a second engaging slot 712 are formed in the blade 71, are adjacent to or at the rear end 713 of the blade 71, and are sequentially arranged in the longitudinal direction of the blade 71. The engaging slots 711 and 712 are elongated in shape and are connected to, and hence in communication with, each other. The first engaging slot 711 is closer to the blade tip 710 than is the second engaging slot 712, and the first engaging slot 711 has a smaller slot width than the second engaging slot 712. One end of the engaging and positioning base 73 is extended with an engaging portion 731 for engaging with and securing the blade 71. The other end (referred to as the second end) of the engaging and positioning base 73 is connected to the handle 72. The width of a front section of the engaging portion 731 is greater than the slot width of the first engaging slot 711 but slightly less than the slot width of the second engaging slot 712. The periphery of the front section of the engaging portion 731 is concavely provided with a groove 730. The engaging and positioning base 73 is also concavely provided with a sunken portion 733 adjacent to a rear section of the engaging portion 731, and the configuration of the sunken portion 733 matches the configuration of the rear end 713 of the blade 71. When it is desired to mount the blade 71 on the engaging and positioning base 73, the user must grip the handle 72 and the blade 71 with two hands respectively and insert the front section of the engaging portion 731 into the second engaging slot 712 at a predetermined angle (i.e., by keeping the engaging portion 731 at a predetermined inclination angle with respect to the blade 71) so that the groove 730 corresponds to the joint between the first engaging slot 711 and the second engaging slot 712. Then, the fingers gripping the blade 71 respectively from its two lateral sides must apply a force to the blade 71 in order to displace the blade 71 toward the handle 72 so that the rear end 713 of the blade 71 is pressed against and deformed, or more specifically twisted, by the rear section of the engaging portion 731, thereby allowing the front section of the engaging portion 731 to be engaged in the first engaging slot 711 through the groove 731. Once the rear end 713 of the blade 71 moves past the rear section of the engaging portion 731, the first engaging slot 711 and the second engaging slot 712 are engaged with and positioned along the periphery of the engaging portion 731, with the rear end 713 of the blade 71 positioned in the sunken portion 733. The rear end 713 of the blade 71 in this state is no longer pressed against the rear section of the engaging portion 731, meaning the blade 71 has been automatically removed from the deformed, or twisted, state and is therefore securely mounted on the engaging and positioning base 73. With continued reference to FIG. 2, a portion of the pushing plate 74 that is at or adjacent to a middle section of the pushing plate 74 is pivotally provided, by way of a pivot shaft 70, on the handle 72 and a portion of the engaging and positioning base 73 that is adjacent to the second end of the engaging and positioning base 73. One end of the pushing plate 74 is provided with a pressing portion 741, and the other end of the pushing plate 74 is provided with a pushing portion 742. As shown in FIG. 2 and FIG. 3, the second end of the engaging and positioning base 73 is provided with a mounting groove 734 adjacent to the sunken portion 733, and the pivot shall 70 can be passed through the mounting groove 734 to position the pushing plate 74 pivotally on the handle 72 and in the mounting groove 734. As the pressing portion 741 is movably located adjacent to the rear end 713 of the blade 71 and the sunken portion 733, pushing the pushing plate 74 (i.e., rotating the pushing plate 74 about the pivot shaft 70) will bring the pressing portion 741 toward or away from the sunken portion 733. The operation of replacing the blade 71 of the knife structure 7 is described below with reference to FIG. 3 and FIG. 4. To begin with, the user pushes the pushing portion 742 with a finger (e.g., the thumb or index finger) of the hand holding the handle 72 (e.g., the right hand), and the pushing plate 74 is rotated (in the direction indicated by the arrow in FIG. 3) as a result, with the pressing portion 741 extending into the sunken portion 733 and consequently pressing against the rear end 713 of the blade 71. The rear end 713 of the blade 71, therefore, is deformed, or more specifically twisted, by the pressing force of the pressing portion 741 and moved away from the sunken portion 733 such that the second engaging slot 712 is no longer engaged with and positioned at the rear section of the engaging portion 731. Now, the user only has to grip the blade 71 from two lateral sides respectively with two fingers (e.g., the thumb and the index finger) of the other hand (e.g., the left hand) and apply a force to the blade 71, and the blade 71 will be displaced away from the handle 72 and thus detached from the engaging and positioning base 73. After that, a new blade 71 of a different type from the detached one (or of the same type as the detached one) can be mounted on the engaging and positioning base 73 according to the aforesaid procedure of mounting the blade 71 so that the user can use and maneuver the new blade 71 safely and steadily while holding the handle 72.

The knife structure 7 described above allows the user to buy blades 71 of different configurations (e.g., a plain-edge blade, a partly-serrated-edge (or combo-edge) blade, a fully-serrated-edge blade, and so on) as needed and mount a suitable one of the blades 71 on the engaging and positioning base 73 according to the usage scenario to deal with, so there is no need for the user to buy different types of knives. The knife structure 7 not only helps reduce the user's purchase cost, but also provides improvement in the convenience of maintenance, in portability (the user only has to carry one knife with them, along with the blade 71 replacements to be used), and in durability (the user can replace any worn blade 71 while keeping the handle 72, which the user may have grown accustomed to). Moreover, since a manufacturer does not have to produce an individual knife for each blade 71, the knife structure 7 makes it easier for the manufacturer to control the production and warehousing procedures and costs. After actual production and use of the knife structure 7, however, it has been found that the knife structure 7 still suffers from certain inadequacies that are shared with the foregoing conventional scalpel 10. First, with continued reference to FIG. 2 to FIG. 4, a user is still required to grip the blade 71 and the handle 72 with two hands respectively in order to mount the blade 71 to the handle 72 or detach the blade 71 from the handle 72. Second, once the engaging slots 711 and 712 of the blade 71 are aligned with the groove 730, the user must firmly grip, and apply a force to, the blade 71 with two fingers of the hand other than the one holding the handle 72, in order to move the blade 71 toward the handle 72 until the rear end 713 of the blade 71 is pressed against and consequently deformed, or twisted, by the rear section of the engaging portion 731, so that the engaging portions 714 on the two corresponding lateral sides of the first engaging slot 711 of the blade 71 can be engaged in the groove 730 to couple the blade 71 and the handle 72 securely together. Third, when it is desired to detach the blade 71 from the handle 72, the user still has to hold the handle 72 in one hand, grip the blade 71 firmly from two lateral sides with two fingers of the other hand respectively, and push at the rear end 713 of the blade 71 in order to deform, or twist, the blade 71 and thereby raise the rear end 713 to a position as high as the top edge of the rear section of the engaging portion 731 so that the blade 71 can be pulled forward and detached from the handle 72.

In short, whether to mount the blade 71 to the handle 72 or to detach the blade 71 from the handle 72, a user of the knife structure 7 is required to not only use both hands, but also firmly grip, and apply a force of a certain magnitude, to the blade 71 from two lateral sides respectively with two fingers of the hand other than the one holding the handle 72, the objective being to force the blade 71 into deformation, or more specifically to twist the blade 71, so that the engaging portions 714 on the two corresponding lateral sides of the first engaging slot 711 of the blade 71 can be securely engaged in or separated from the groove 730 to either mount the blade 71 to the handle 12 or detach the blade 71 from the handle 72. As the two lateral sides of the blade 71 do not provide large gripping areas for the two fingers, and the cutting edge of the blade 71 is extremely sharp, it is not only prohibitively difficult, but also quite frightening, if not unsafe, to mount the blade 71 to the handle 72 or detach the blade 71 from the handle 72 by gripping the blade 71 and applying thereto a force large enough to deform, or twist, the blade 71. This also explains why most users are always unable to mount or detach the blade 71 to or from the handle 72 easily, effortlessly, and safely.

In view of the fact that a knife user tends to buy knives of different cutting edge configurations according to practical needs and thus incurs a high purchase cost and the inconvenience of carrying those knives around, the present disclosure, as a result of forty years of experience in the development of knife-related products, extensive research and repeated trials and tests, provides a knife allowing rapid and safe replacement and securement of a blade, and a connecting base of the knife. It is hoped that the knife disclosed herein and its connecting base provide an effective solution to the issue that the conventional knife and conventional scalpel described above do not allow a blade to be safely and conveniently mounted thereto or detached therefrom.

SUMMARY

In view of the fact that a knife user tends to buy knives of different cutting edge configurations according to practical needs and thus incurs a high purchase cost and the inconvenience of carrying those knives around, the present disclosure, as a result of forty years of experience in the development of knife-related products, extensive research and repeated trials and tests, provides a knife allowing rapid and safe replacement and securement of a blade, and a connecting base of the knife. It is hoped that the knife disclosed herein and its connecting base provide an effective solution to the issue that the conventional knife and conventional scalpel described above do not allow a blade to be safely and conveniently mounted thereto or detached therefrom.

One aspect of the present disclosure is directed to a knife allowing rapid and safe replacement and securement of a blade. The knife includes a blade, a connecting base and a handle. The blade is formed with a blade tip at a front end thereof and, along a longitudinal direction of the blade, and a locking groove that is adjacent to or at a rear end thereof, elongated in shape, has an open end and a closed end formed with a locking hole communicating with the locking groove, and has a first groove width at a portion of the locking groove adjacent to or at the open end that is greater than or equal to a second groove width of a remaining portion of the locking groove, so as to facilitate it to be smoothly pushed to be engaged with a corresponding locking post. A hole diameter of the locking hole is greater than the second groove width. The connecting base includes an upper base body, a lower base body, a spacer plate and a lock-release member. The spacer plate can lie between and adjacent to rear ends of the upper base body and the lower base body and form an engaged-connection groove along with the upper base body and the lower base body when lying between the upper base body and the lower base body. A shape and a width of the engaged-connection groove respectively match a shape and a thickness of a portion of the blade that is at or adjacent to the rear end of the blade so that the engaged-connection groove can be engaged and inserted with the portion of the blade that is adjacent to the rear end of the blade. The lock-release member includes a positioning sleeve, a lock-release post, an elastic element and a lock-release button. The positioning sleeve is concavely provided with a slide groove extending in an axial direction thereof and having one end that can be fixed on one side of the connecting base. The lock-release post can penetrate the upper base body and the lower base body at corresponding positions of the upper base body and the lower base body that are respectively adjacent to rear ends of the upper base body and the lower base body. The lock-release post includes a releasing post and the locking post. The releasing post has a post diameter matching the second groove width of the locking groove and has one end that can be exposed from the other side of the connecting base. The locking post has one end connected to the other end of the releasing post along an axial direction of the lock-release post and the other end concavely provided with a positioning groove extending in the axial direction of the lock-release post, and has a post diameter matching the hole diameter of the locking hole and greater than the second groove width of the locking groove. The locking post can be extended through the locking hole but not the remaining portion of the locking groove, and slide in the slide groove along the axial direction of the positioning sleeve. The elastic element has one end that can press against an inner surface of the other end of the positioning sleeve through the slide groove and the other end that can be positioned at and press against an inner surface of the positioning groove to allow the locking post to slide in the slide groove along the axial direction of the positioning sleeve. The lock-release button can be fixed at the one end of the releasing post and be released by a user to displace the locking post to a position corresponding to the locking hole to bring the blade inserted into and engaged with the engaged-connection groove into a locked state in which the blade is securely positioned and undetachable, and pressed by the user to displace the releasing post to the position corresponding to the locking hole to bring the blade inserted into and engaged with the engaged-connection groove into an unlocked state in which the blade is detachable, and to bring the connecting base into a blade-mountable state when the blade is not mounted to the connecting base. The locking groove can, in the unlocked state, be displaced away from the locking post when the blade is applied with a forward pulling force, end an engaging relationship between the blade and the engaged-connection groove, and allow the blade to be detached from the connecting base, and in the blade-mountable state, be displaced into engagement with the locking post. A portion of the handle that is at or adjacent to the front end thereof can be connected to a portion of the connecting base that is at or adjacent to the rear end of the connecting base, so that the user can use and maneuver the new blade safely, steadily, and precisely while holding the handle.

Thus, when the user intends to detach the blade from the connecting base, all that needs to be done is to press and hold the lock-release button with a finger (e.g., the thumb or index finger) of the hand in which the handle is held (e.g., the right hand), the releasing post will be displaced to the position corresponding to the locking hole, and the blade will enter the unlocked state, in which the blade can be rapidly separated from the connecting base. Now, the user only has to grip the blade from two lateral sides respectively with two fingers (e.g., the thumb and the index finger) of the other hand (e.g., the left hand) and apply a forward pulling force to the blade with the same two fingers, and the locking groove will be displaced away from the locking post, thereby terminating the engaging relationship between the blade and the engaged-connection groove, allowing the blade to be detached from the connecting base easily, safely, and rapidly. On the contrary, to mount a new blade to the connecting base, the user only has to hold the handle with one hand; press and hold the lock-release button with a finger of the same hand to displace the releasing post to the position corresponding to the locking hole, thereby allowing the new blade to be mounted; grip the new blade from two lateral sides respectively with two fingers (e.g., the thumb and the index finger) of the other hand (e.g., the left hand); align the rear end of the new blade with the engaged-connection groove and insert the rear end of the new blade into the engaged-connection groove with the two fingers; then using the same two fingers, apply a force to and thereby push the new blade toward the engaged-connection groove such that the locking groove is displaced into engagement with the locking post; and then release the aforesaid finger (e.g., the thumb or index finger) of the first hand (e.g., the right hand) from the lock-release button, and the locking post will be displaced to the position corresponding to the locking hole to establish a secure engaging relationship between the new blade and the engaged-connection groove, thereby allowing the new blade to be easily, safely, and rapidly mounted to the connecting base and securely coupled to the connecting base without getting loose or falling off, so that the user can use and maneuver the new blade steadily and precisely while holding the handle.

Another aspect of the present disclosure is directed to a connecting base that allows a blade to be replaced and secured rapidly and safely. A portion of the connecting base that is at or adjacent to the front end of the connecting base can be inserted by and secure a blade. The rear end of the connecting base can be connected to a handle so that a user can use and maneuver the blade steadily and precisely while holding the handle. The connecting base includes an upper base body, a lower base body, a spacer plate, and a lock-release member. The upper base body is a plate-shaped base body, and the configuration of the upper base body matches the configuration of a portion of the blade that is at or adjacent to the rear end of the blade. The lower base body is a plate-shaped base body, and the configuration of the lower base body matches the configuration of the upper base body. The spacer plate can be located between the upper base body and the lower base body and is adjacent to the rear ends of the two base bodies such that an engaged-connection groove is formed between the upper base body, the lower base body, and the spacer plate. The shape and width of the engaged-connection groove respectively match the shape and thickness of the portion of the blade that is at or adjacent to the rear end of the blade so that the portion of the blade that is at or adjacent to the rear end of the blade can be inserted into and engaged with the engaged-connection groove. The lock-release member includes a positioning sleeve, an elastic element, a lock-release post, and a lock-release button. One end of the positioning sleeve can be fixed on one side of the connecting base and is concavely provided with a slide groove that extends along an axial direction thereof. One end of the elastic element can extend into the slide groove and press against the inner surface of the other end of the positioning sleeve. The lock-release post can penetrate the upper base body and the lower base body at corresponding positions of the two base bodies that are respectively adjacent to the rear ends of the base bodies. The lock-release post includes a locking post and a releasing post. One end of the locking post can be connected to one end of the releasing post along the axial direction of the lock-release post. The post diameter of the locking post matches the hole diameter of a locking hole of the blade but is greater than the groove width of a remaining portion of a locking groove of the blade that excludes a portion at or adjacent to an open end of the locking groove, and the post diameter of the releasing post matches of the remaining portion of the locking groove. The locking post, therefore, can extend through the locking hole but cannot extend through the remaining portion of the locking groove. The other end of the locking post is concavely provided with a positioning groove that extends in the axial direction of the lock-release post so that the other end of the elastic element can be positioned at and press against the inner surface of the positioning groove to allow the locking post to slide in the slide groove along the axial direction of the positioning sleeve. The other end of the releasing post can be exposed from the other side of the connecting base, and the lock-release button can be fixed at this end of the releasing post. The user may choose to not press or to press and hold the lock-release button in order to displace the locking post or the releasing post to a position corresponding to the locking hole, thereby bringing the blade engaged in the engaged-connection groove either into a locked state, in which the blade is securely positioned and cannot be detached, or into an unlocked state, in which the blade can be detached.

Thus, whether the user intends to mount the blade to the connecting base or detach the blade from the connecting base, all that needs to be done is to either release the lock-release button or press and hold the lock-release button with a finger (e.g., the thumb or index finger) of the hand in which the handle is held (e.g., the right hand), and the blade will enter the locked state, in which the blade cannot be separated from the connecting base, or the unlocked state, in which the blade can be rapidly separated from the connecting base, accordingly. During the process, it is unnecessary for the user to grip the blade with fingers and apply through the fingers to the blade a force large enough to deform, or twist, the blade, so any user will be able to complete the blade mounting and detaching operations on the knife, or more particularly its connecting base, of the present disclosure in an easy, effortless, rapid, and safe manner and use and maneuver the mounted blade steadily, safely, and precisely. The blade will stay in the locked state, in which the blade is securely positioned and cannot be separated from the connecting base, when used to cut any object. Consequently, the safety and stability of use of the knife according to the present disclosure and its connecting base are ensured.

Another aspect of the present disclosure is directed to a knife including a handle having a front end that can be integrally formed with, fixedly connected to, or pivotally connected to a rear end of the connecting base so that the user can use and maneuver the blade steadily and precisely while holding the handle. The handle includes an upper handle portion and a lower handle portion that collectively form a receiving space therebetween when assembled with each other. The receiving space matches the blade in configuration and can receive the blade therein when the blade is not in use to ensure the safety of the user. Further, the front end of the handle that can be pivotally connected to the rear end of the connecting base, so that the connecting base and the blade inserted therein and engaged therewith can be rotatably relative to the handle, be rotated into and stored in the receiving space, and spun out of the handle, making the knife a foldable knife.

Accordingly, the user needs only to carry a single knife, and can easily, quickly and safely change the blade of different configurations based on his or her needs, which greatly improves on the convenience of portability, the safety and stability in use.

This and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
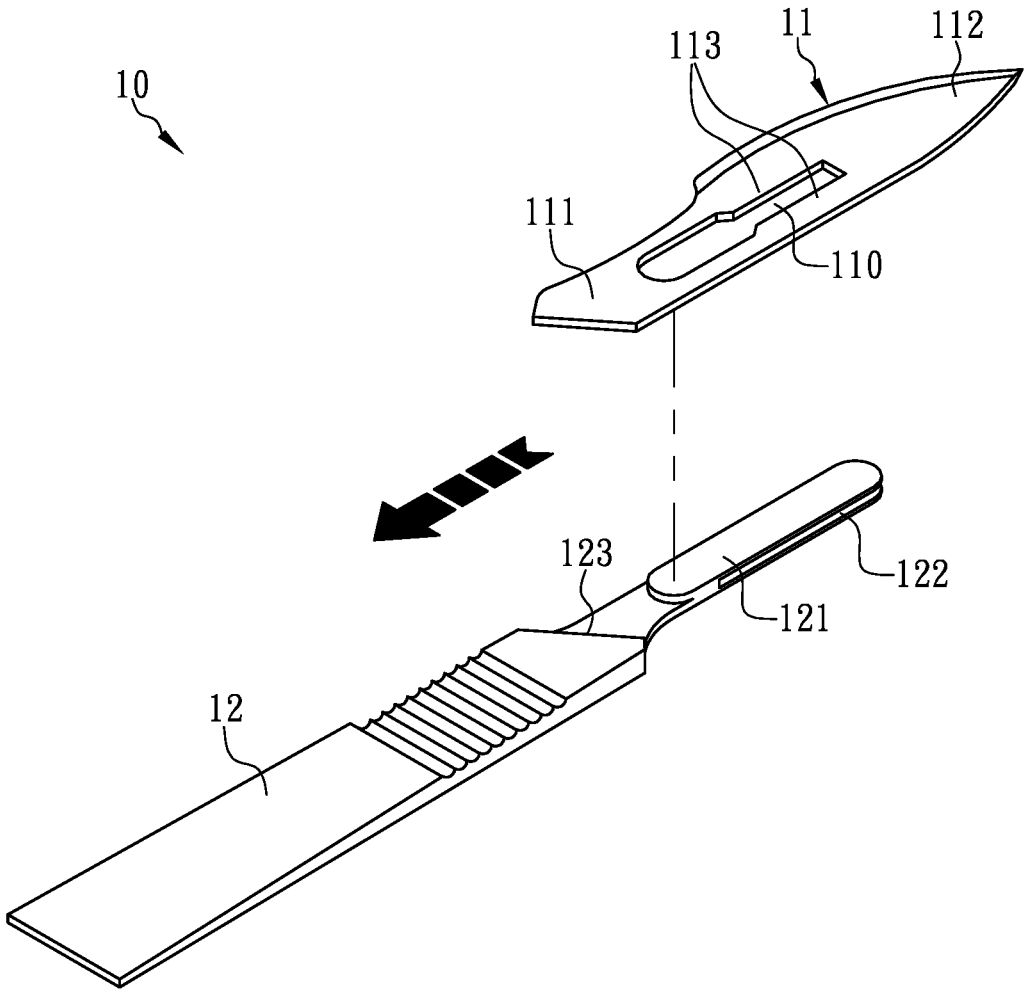
FIG. 1(Prior Art)
FIG. 1 is an exploded view of a conventional scalpel.
Figure 2:
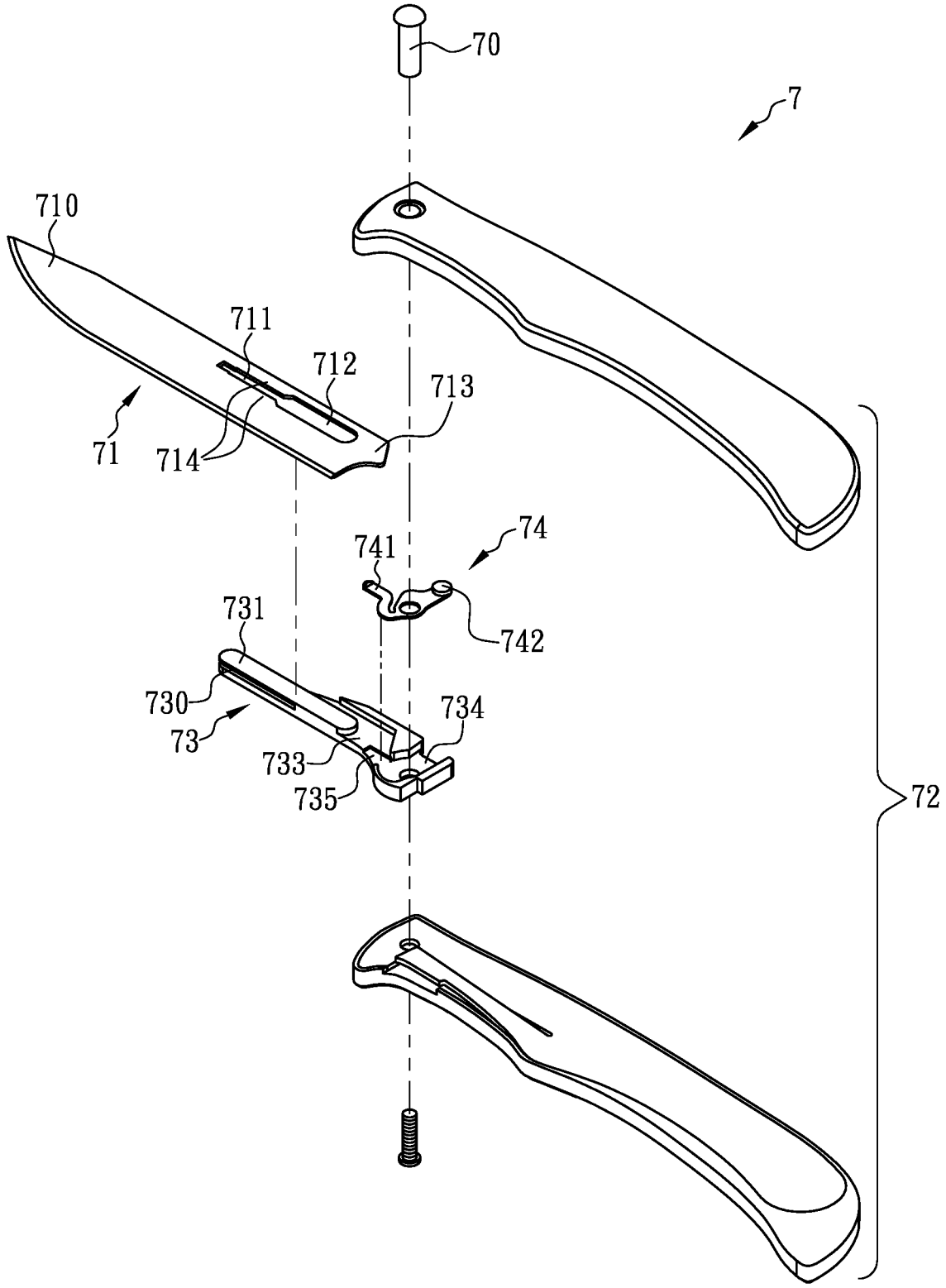
FIG. 2(Prior Art)
FIG. 2 is an exploded view of a conventional knife.
Figure 3:
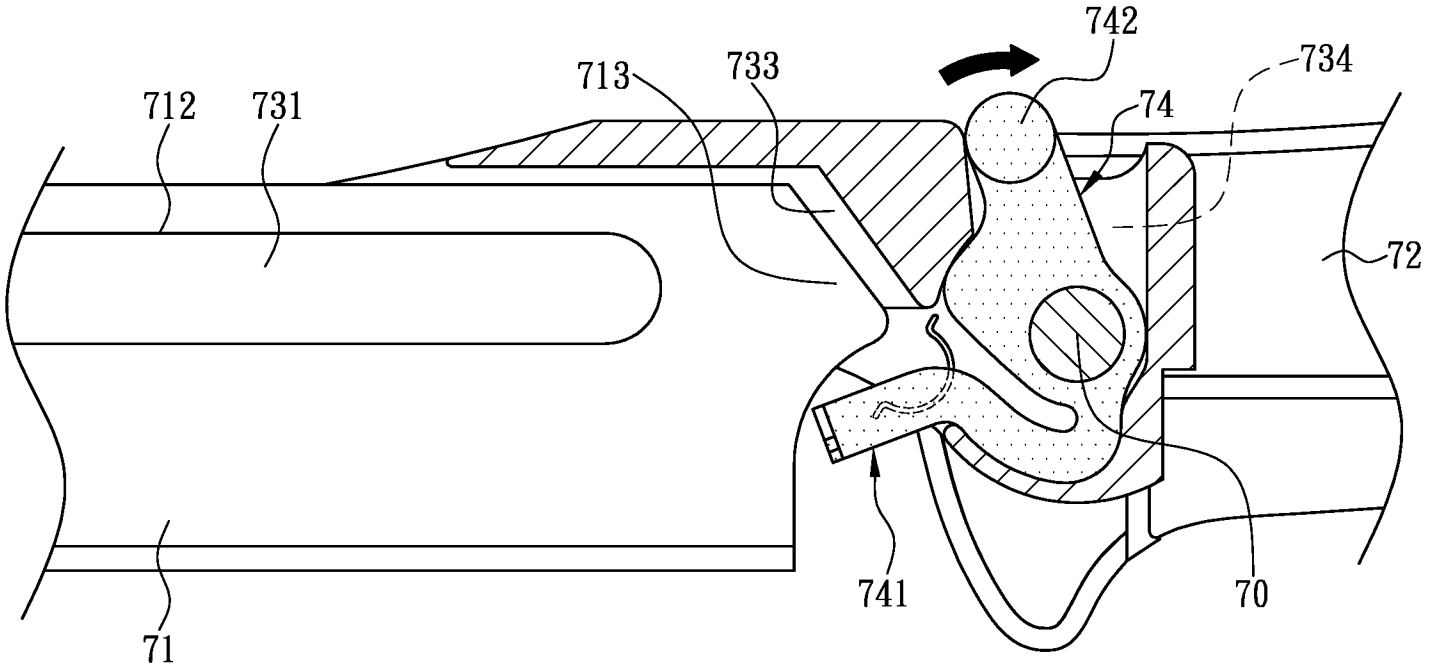
FIG. 3(Prior Art)
FIG. 3 is a schematic diagram of the conventional knife in a using state.
Figure 4:
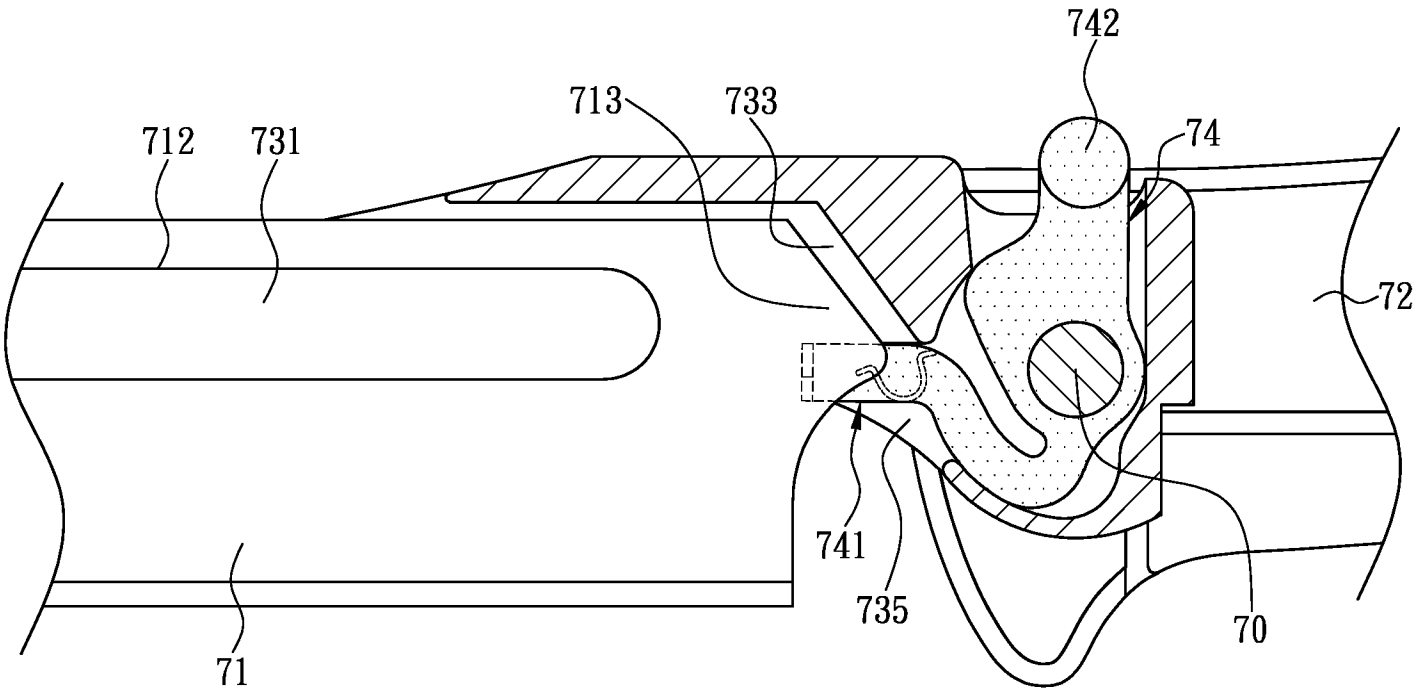
FIG. 4(Prior Art)
FIG. 4 is a schematic diagram of the conventional knife in another using state.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. The numbering terms such as "first", "second" or "third", etc. can be used to describe various components, parts or the like, and the directional terms such as "upper", "lower", "front", "rear", "right", "left", etc., can be used to describe the direction of the components, parts or the like, which are for distinguishing one component/part from another one, and distinguishing one direction of one component/part from another one only, and are not intended to, nor should be construed to impose any substantive limitations on the components, parts or the like or the directions thereof, or be relevant to the sequence in which the components/parts are to be assembled or disposed in practical application.

Figure 5:
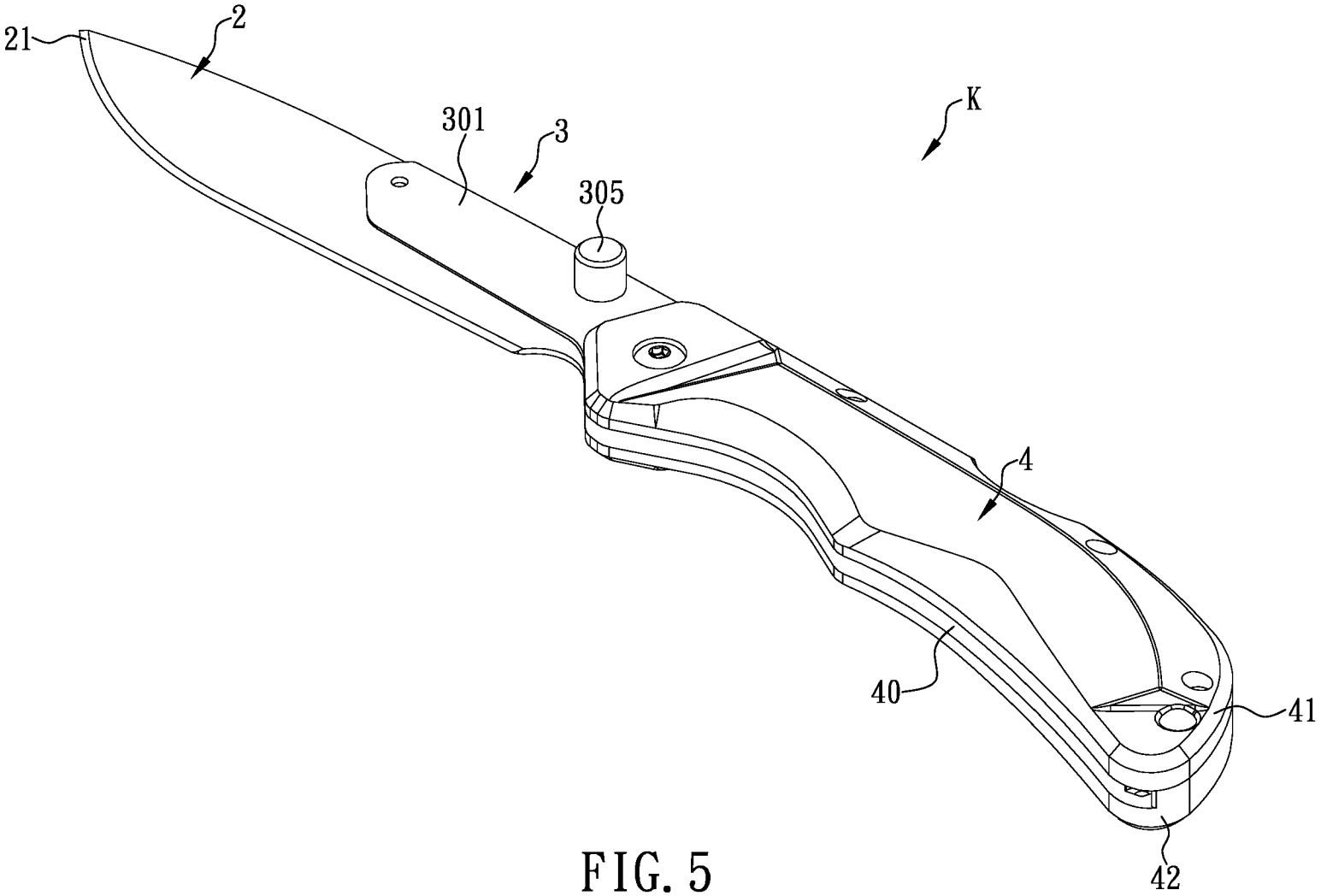
FIG. 5 is a schematic diagram of a knife in an using state according to certain embodiments of the present disclosure.
Figure 6:
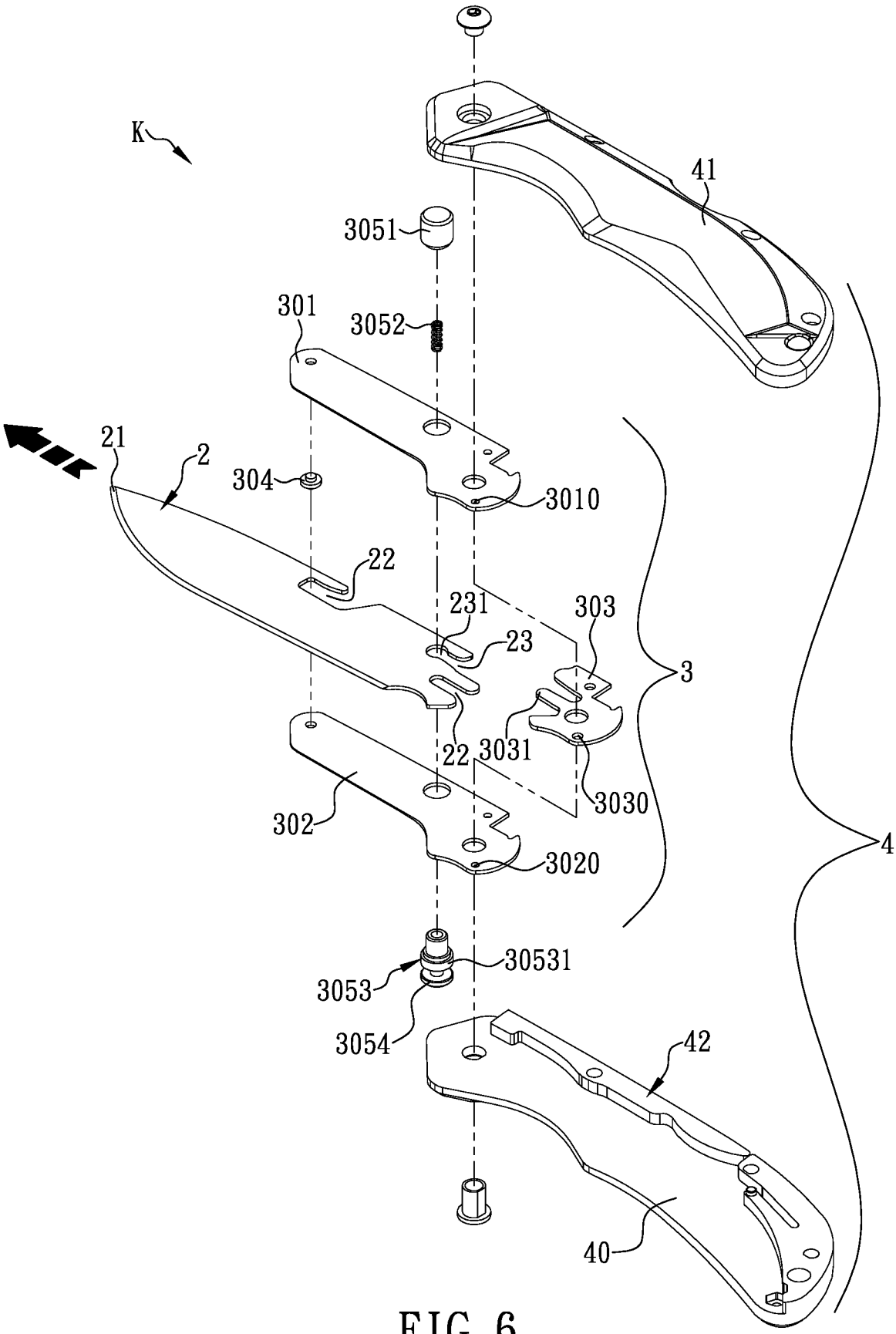
FIG. 6 is an exploded top view of the knife according to certain embodiments of the present disclosure.

The present disclosure provides a knife allowing rapid and safe replacement and securement of a blade, and a connecting base of the knife. Referring to FIG. 5, the knife K includes a blade 2, a connecting base 3, and a handle 4. As shown in FIG. 5 and FIG. 6, the blade 2, which can be a saw blade or any other tool plate that can be used to cut an object, is formed with a blade tip 21 at the front end thereof. At least one engaging groove 22 and a locking groove 23 are formed in the blade 2, are at or adjacent to the rear end of the blade 2, and extend along the longitudinal direction of the blade 2. Each of the 22 and the locking groove 23 can be a slot with an open end, and has a first groove width at a portion of the groove that is adjacent to or at the open end and greater than or equal to a second groove width of the remaining portion of the groove, so as to be smoothly pushed into engagement with a corresponding engaging post 304 or a locking post 30531. With continued reference to FIG. 5 and FIG. 6, the closed end of the locking groove 23 is formed with a locking hole 231. The locking hole 231 is in communication with the locking groove 23 and has a hole diameter greater than the second groove width. That is to say, while the first groove width of the portion of the locking groove 23 that is adjacent to the open end of the locking groove 23 can be greater than, equal to, or less than the hole diameter of the locking hole 231, the second groove width of the remaining portion of the locking groove 23 (which remaining portion does not include the portion at or adjacent to the open end of the locking groove 23) is less than the hole diameter of the locking hole 231.

With continued reference to FIG. 5 and FIG. 6, the connecting base 3 includes an upper base body 301, a lower base body 302, a spacer plate 303, at least one engaging post 304, and a lock-release member 305. The spacer plate 303 can lie between, and is adjacent to the rear ends of, the upper base body 301 and the lower base body 302, and the upper base body 301 and the lower base body 302 are locked together by the at least one engaging post 304, such that an engaged-connection groove 306 is formed between the upper base body 301, the lower base body 302, and the spacer plate 303. The shape and width of the engaged-connection groove 306 respectively match the shape and thickness of the rear end of the blade 2 and/or a portion of the blade 2 that is adjacent to the rear end of the blade 2. A portion of the spacer plate 303 that is at or adjacent to the front end of the spacer plate 303 is protrudingly provided with at least one engaging portion 3031 that extends forward. The configuration of each engaging portion 3031 matches the configuration of the corresponding engaging grove 22 so that, in response to the rear end of the blade 2 and/or the portion of the blade 2 that is adjacent to the rear end of the blade 2 being inserted into and engaged with the engaged-connection groove 306, each engaging groove 22 is engaged with and connected to the corresponding engaging post 304 or engaging portion 3031.

It should be pointed out that the number of the engaging grooves 22 shown in FIG. 6 is by way of example only, and the present disclosure can be implemented with only one engaging groove 22 or more than two engaging grooves 22 to meet practical needs. It is also feasible to dispense with the at least one engaging groove 22, the at least one engaging post 304, and the at least one engaging portion 3031 and pass another element, such as a rivet, sequentially through a through hole 3010 in the upper base body 301, a through hole 3030 in the spacer plate 303, and a through hole 3020 in the lower base body 302 so as to couple the upper base body 301, the spacer plate 303, and the lower base body 302 together. In certain embodiments, it can be the structure of the lock-release member 305 that couples the upper base body 301 and the lower base body 302 together, with the spacer plate 303 clamped therebetween.

Figure 7:
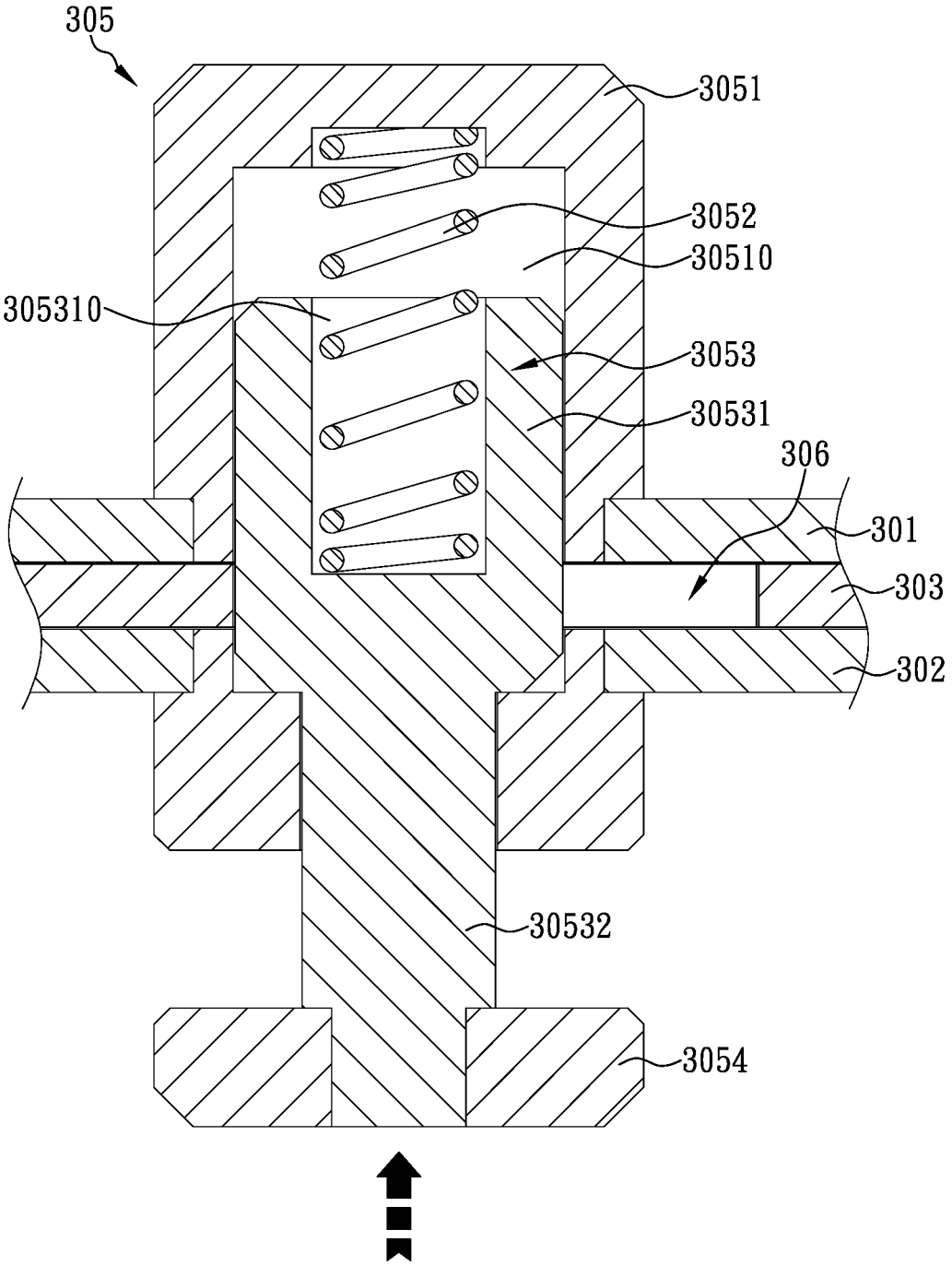
FIG. 7 is a cross-sectional view of the knife in a using state according to certain embodiments of the present disclosure.

As shown in FIG. 6 and FIG. 7, the lock-release member 305 includes a positioning sleeve 3051, an elastic element 3052 (e.g., a coil spring, a volute spring, or a hydraulic device), a lock-release post 3053, and a lock-release button 3054. The positioning sleeve 3051 has one end that can be fixed on one side of the connecting base 3 (e.g., the outer side of one of the upper base body 301 and the lower base body 302), and is concavely provided with a slide groove 30510 that extends in an axial direction thereof. One end of the elastic element 3052 can extend into the slide groove 30510 and press against the inner surface of the other end of the positioning sleeve 3051. The lock-release post 3053 can penetrate the upper base body 301 and the lower base body 302 at corresponding positions of the two base bodies 301 and 302 that are respectively adjacent to the rear ends of the base bodies 301 and 302. The lock-release post 3053 includes a locking post 30531 and a releasing post 30532. One end of the locking post 30531 is connected to one end of the releasing post 30532 along the axial direction of the lock-release post 3053. The post diameter of the locking post 30531 matches the hole diameter of the locking hole 231 but is greater than the second groove width of the locking groove 23, and the post diameter of the releasing post 30532 matches the second groove width of the locking groove 23, so as to allow the locking post 30531 to extend through the locking hole 231 but not the remaining portion of the locking groove 23. The other end of the locking post 30531 is concavely provided with a positioning groove 305310 that extends in the axial direction of the lock-release post 3053 so that the other end of the elastic element 3052 can be positioned at and press against the inner surface of the positioning groove 305310 to allow the locking post 30531 to slide in the slide groove 30510 along the axial direction of the positioning sleeve 3051. The other end of the releasing post 30532 can be exposed from the other side of the connecting base 3 (e.g., the outer side of the other of the upper base body 301 and the lower base body 302), and the lock-release button 3054 can be fixed at the other end of the releasing post 30532. A user may choose to not press (or release) or to press and hold the lock-release button 3054 with a finger (e.g., the index finger) of the hand holding the handle 4 in order to displace the locking post 30531 or the releasing post 30532 to a position corresponding to the locking hole 231, thereby bringing the blade 2 inserted into and engaged with the engaged-connection groove 306 either into a locked state, in which the blade 2 is securely positioned and cannot be detached, or into an unlocked state, in which the blade 2 can be detached. Referring to FIG. 5 and FIG. 6, a portion of the handle 4 that is adjacent to or at the front end of the handle 4 can be connected to (e.g., integrally formed with, fixedly connected to, or pivotally connected to) a portion of the connecting base 3 that is adjacent to or at the rear end of the connecting base 3 so that by holding the handle 4, a user can use and maneuver the blade 2 in a steady, safe, and precise manner.

When it is desired to detach the blade 2 from the connecting base 3, referring to FIG. 5 and FIG. 7, the user only has to hold the handle 4 with one hand (e.g., the right hand); press and hold the lock-release button 3054 with a finger (e.g., the thumb or index finger) of the same hand (e.g., the right hand)(as indicated by the dashed-line arrow in FIG. 7) to displace the releasing post 30532 to the position corresponding to the locking hole 231 such that the blade 2 enters the unlocked state, in which the blade 2 can be detached; and then, referring to FIG. 6 and FIG. 7, grip the blade 2 from two lateral sides respectively with two fingers (e.g., the thumb and the index finger) of the other hand (e.g., the left hand) and apply a forward pulling force to the blade 2 (as indicated by the dashed-line arrow in FIG. 6) with the same two fingers, and each engaging groove 22 and the locking groove 23 will be displaced away from the corresponding engaging post 304 or the locking post 30531 respectively, thereby terminating the engaging relationship between the blade 2 and the engaged-connection groove 306, allowing the blade 2 to be detached from the connecting base 3 easily, safely, and rapidly.

Figure 8:
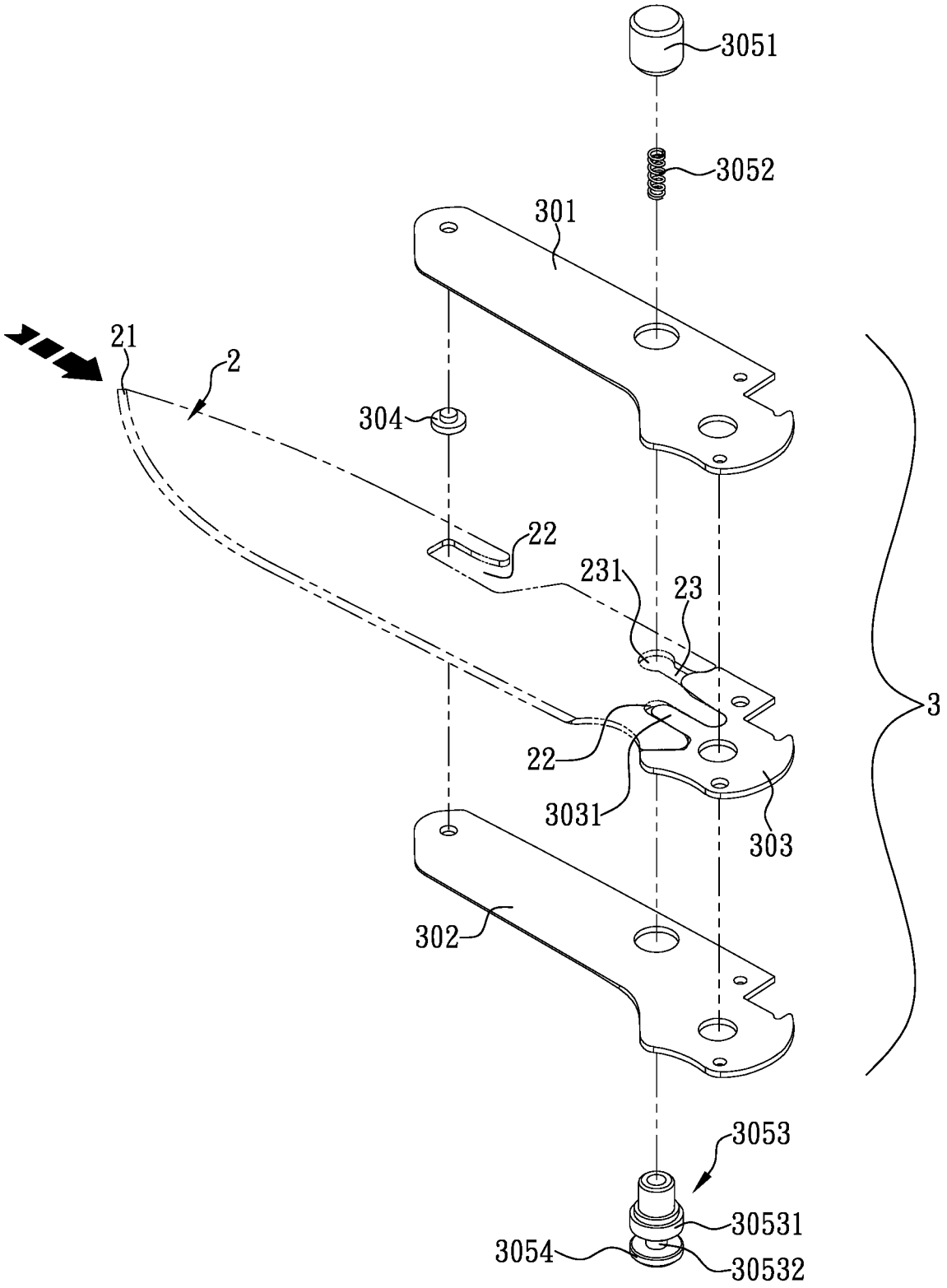
FIG. 8 is an exploded bottom view of the knife according to certain embodiments of the present disclosure.
Figure 9:
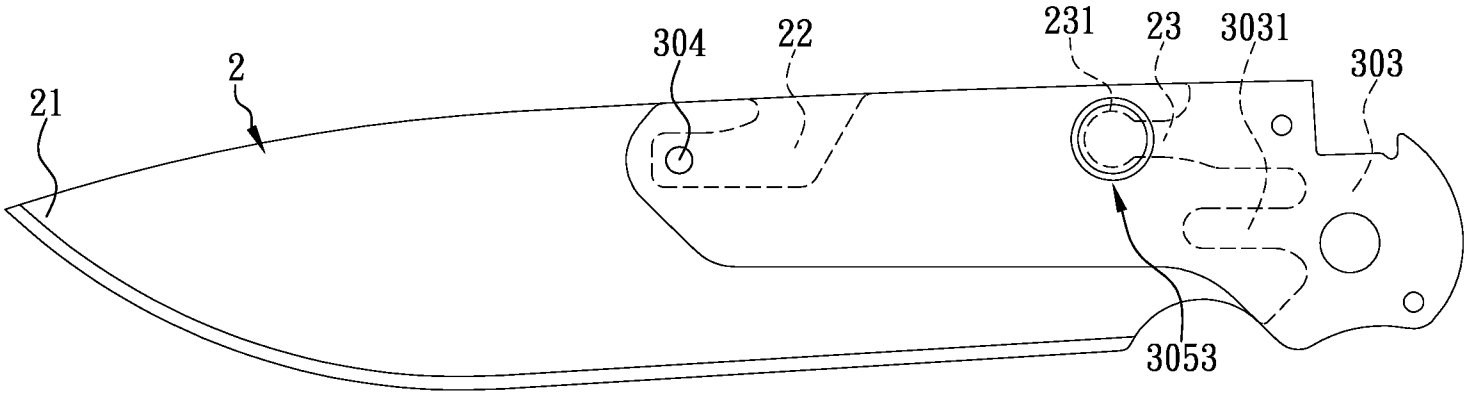
FIG. 9 is a schematic diagram of the knife and a connecting base assembled with each other according to certain embodiments of the present disclosure.

To mount a new blade 2 to the connecting base 3, referring to FIG. 7, FIG. 8, and FIG. 9, the user only has to hold the handle 4 with one hand (also referred to as the first hand, e.g., the right hand); press and hold the lock-release button 3054 with a finger (e.g., the thumb or index finger) of the same hand (e.g., the right hand) to displace the releasing post 30532 to the position corresponding to the locking hole 231, thereby allowing the new blade 2 to be mounted; grip the new blade 2 from two lateral sides respectively with two fingers (e.g., the thumb and the index finger) of the other hand (e.g., the left hand); align the rear end of the new blade 2 with the engaged-connection groove 306 and insert the rear end of the new blade 2 into the engaged-connection groove 306 with the two fingers; then using the same two fingers, apply a force to and thereby push the new blade 2 toward the engaged-connection groove 306 (as indicated by the dashed-line arrow in FIG. 8) such that each engaging groove 22 and the locking groove 23 are respectively displaced into engagement with the corresponding engaging post 304 (or the corresponding engaging portion 3031) and the locking post 30531; and then release the aforesaid finger (e.g., the thumb or index finger) of the first hand (e.g., the right hand) from the lock-release button 3054 (i.e., release the lock-release button 3054), and the locking post 30531 will be displaced to the position corresponding to the locking hole 231 to establish a secure engaging relationship between the new blade 2 and the engaged-connection groove 306, thereby allowing the new blade 2 to be easily, safely, and rapidly mounted to the connecting base 3 and securely coupled to the connecting base 3 without getting loose or falling off.

Thus, whether the user intends to mount the blade 2 to the connecting base 3 or detach the blade 2 from the connecting base 3, all that needs to be done is to either release the lock-release button 3054 or press and hold the lock-release button 3054 with a finger (e.g., the thumb or index finger) of the hand in which the handle 4 is held (e.g., the right hand), and the blade 2 will enter the locked state, in which the blade 2 cannot be separated from the connecting base 3, or the unlocked state, in which the blade 2 can be rapidly separated from the connecting base 3, accordingly. During the process, it is unnecessary for the user to grip the blade 2 with fingers and apply through the fingers to the blade 2 a force large enough to deform, or twist, the blade 2, so any user will be able to mount or detach the blade 2 to or from the structure of the knife K, or more particularly of the connecting base 3, according to the present disclosure in an easy, effortless, rapid, and safe manner and use and maneuver the mounted blade 2 steadily. The blade 2 will stay in the locked state, in which the blade 2 is securely positioned and cannot be separated from the connecting base 3, when used to cut any object with precision. Consequently, the safety and stability of use of the knife according to the present disclosure and its connecting base are ensured.

It should be pointed out that the present disclosure is not limited to the embodiments described above. In certain embodiments, the number of the at least one engaging post 304 can be increased as needed while the number of the at least one engaging portion 3031 of the spacer plate 303 is reduced, or the number of the at least one engaging portion 3031 of the spacer plate 303 can be increased as needed while the number of the at least one engaging post 304 is reduced. Any such modification shall fall within the scope of the present disclosure, as long as each engaging groove 22 formed in, and along the longitudinal direction of, the blade 2 can be engaged with the corresponding engaging post 304 or engaging portion 3031 to render the blade 2 securely inserted in and engaged with the engaged-connection groove 306.

In certain embodiments, referring to FIG. 7, FIG. 8, and FIG. 9, a portion of the handle 4 that is at or adjacent to the front end of the handle 4 is connected to (e.g., integrally formed with, fixedly connected to, or pivotally connected to) a portion of the connecting base 3 that is at or adjacent to the rear end of the connecting base 3 so that by holding the handle 4, a user can use and maneuver the blade 2 in a steady and precise manner. The handle 4 includes an upper handle portion 41 and a lower handle portion 42. The upper handle portion 41 and the lower handle portion 42 can make up the handle 4 and form a receiving space 40 (see FIG. 5 and FIG. 6) between the upper handle portion 41 and the lower handle portion 42. The receiving space 40 matches the blade 2 in configuration so that the blade 2 can be stored in the receiving space 40 when not in use, thereby ensuring the user's safety. The front end of the handle 4 can be pivotally connected to the rear end of the connecting base 3, and both the connecting base 3 and the blade 2 securely engaged therewith will be rotatable with respect to the handle 4, meaning the connecting base 3 and the blade 2 securely engaged therewith will be able to be rotated into and thus stored in the receiving space 40 or spun out of the handle 4 as desired, thereby turning the structure of the knife K into that of a folding knife. In certain embodiments, however, the knife K can have a non-foldable configuration, and the connecting base 3 can be located entirely between the upper handle portion 41 and the lower handle portion 42, that is, the upper handle portion 41 and the lower handle portion 42 can sandwich the connecting base 3 therebetween.

Again, the present disclosure is not limited to the embodiments described above. It should be particularly pointed out that when implementing the embodiments of the present disclosure, the connecting base 3 and the handle 4 may be designed as a single unit, i.e., may jointly form a handle structure, to meet practical needs. In that case, a user may also buy blades of various specifications and functions as needed and can mount or detach each blade to or from the handle structure according to the present disclosure easily, effortlessly, rapidly, and safely.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A knife, comprising:

a blade formed with a blade tip at a front end thereof and, along a longitudinal direction of the blade, a locking groove that is adjacent to or at a rear end thereof, is elongated in shape, has an open end and a closed end formed with a locking hole communicating with the locking groove, and has a first groove width at a portion of the locking groove adjacent to or at the open end that is greater than or equal to a second groove width of a remaining portion of the locking groove, wherein a hole diameter of the locking hole is greater than the second groove width;

a connecting base, comprising:

an upper base body;

a lower base body;

a spacer plate configured to lie between and adjacent to rear ends of the upper base body and the lower base body and form an engaged-connection groove along with the upper base body and the lower base body when lying between the upper base body and the lower base body, wherein a shape and a width of the engaged-connection groove respectively match a shape and a thickness of the rear end of the blade or of a portion of the blade that is adjacent to the rear end of the blade, and the engaged-connection groove is configured to engage and be inserted with the rear end of the blade or the portion of the blade that is adjacent to the rear end of the blade; and a lock-release member, comprising:

a positioning sleeve concavely provided with a slide groove extending in an axial direction thereof and having one end configured to be fixed on one side of the connecting base;

a lock-release post configured to penetrate the upper base body and the lower base body at positions of the upper base body and the lower base body that are respectively adjacent to the rear ends of the upper base body and the lower base body, and comprising:

a releasing post having a post diameter matching the second groove width of the locking groove and having one end configured to be exposed from the other side of the connecting base; and a locking post having one end connected to the other end of the releasing post along an axial direction of the lock-release post and the other end concavely provided with a positioning groove extending in the axial direction of the lock-release post, having a post diameter matching the hole diameter of the locking hole and greater than the second groove width of the locking groove, and configured to be extended through the locking hole but not the remaining portion of the locking groove, and slide in the slide groove along the axial direction of the positioning sleeve;

an elastic element having one end configured to press against an inner surface of the other end of the positioning sleeve through the slide groove and the other end configured to be positioned at and press against an inner surface of the positioning groove to allow the locking post to slide in the slide groove along the axial direction of the positioning sleeve; and a lock-release button configured to be fixed at the one end of the releasing post and configured to be released by a user to displace the locking post to a position corresponding to the locking hole to bring the blade inserted into and engaged with the engaged-connection groove into a locked state in which the blade is securely positioned and undetachable, and be pressed by a user to displace the releasing post to the position corresponding to the locking hole to bring the blade inserted into and engaged with the engaged-connection groove into an unlocked state in which the blade is detachable, and to bring the connecting base into a blade-mountable state when the blade is not mounted to the connecting base; and a handle configured to be connected to the connecting base, wherein the locking groove is configured to, in the unlocked state, be displaced away from the locking post when the blade is applied with a forward pulling force, end an engaging relationship between the blade and the engaged-connection groove, and allow the blade to be detached from the connecting base, and in the blade-mountable state, be displaced into engagement with the locking post.

2. The knife according to claim 1, wherein at least one engaging groove is formed at or adjacent to the rear end of the blade, extending in the longitudinal direction of the blade, elongated in shape, and having an open end; a first groove width at a portion of the engaging groove that is adjacent to or at the open end is greater than or equal to a second groove width of a remaining portion of the engaging groove; the connecting base further comprises an engaging post configured to lock together the upper base body and the lower base body; a portion of the spacer plate that is at or adjacent to a front end of the spacer plate is protrudingly provided with at least one engaging portion that extends forward and has a configuration matching a configuration of the corresponding engaging groove; and the engaging groove is configured to be engaged with and connected to the corresponding engaging post or the corresponding engaging portion in response to the rear end of the blade or the portion of the blade that is adjacent to the rear end of the blade being inserted into and engaged with the engaged-connection groove, and, in the unlocked state, be displaced away from the corresponding engaging post or the corresponding locking post in response to the blade being applied with a forward pulling force.

3. The knife according to claim 1, wherein the handle comprises an upper handle portion and a lower handle portion that collectively form a receiving space therebetween when assembled with each other, and the receiving space matches the blade in configuration and is configured to receive the blade therein.

4. The knife according to claim 3, wherein a front end of the handle is configured to be pivotally connected to a rear end of the connecting base, and the connecting base and the blade are configured to be rotatably engaged with the handle, be rotated into and stored in the receiving space, and spun out of the handle.

5. The knife according to claim 1, wherein the handle comprises an upper handle portion and a lower handle portion that are configured to sandwich the connecting base therebetween.

6. A connecting base, having a portion at or adjacent to a front end of the connecting base that is configured to be inserted into and connected with a blade, and a rear end configured to be connected to a handle, and comprising:

an upper base body in a plate shape and matching in configuration a rear end of the blade or a portion of the blade that is adjacent to the rear end of the blade;

a lower base body in a plate shape and matching the upper base body in configuration;

a spacer plate configured to lie between and adjacent to rear ends of the upper base body and the lower base body, and form an engaged-connection groove along with the upper base body and the lower base body when lying between the upper base body and the lower base body, wherein a shape and a width of the engaged-connection groove respectively match a shape and a thickness of the rear end of the blade or of the portion of the blade that is adjacent to the rear end of the blade, and the engaged-connection groove is configured to engage and be inserted with the rear end of the blade or the portion of the blade that is adjacent to the rear end of the blade; and a lock-release member, comprising:

a positioning sleeve concavely provided with a slide groove extending in an axial direction thereof and having one end configured to be fixed on one side of the connecting base;

a lock-release post configured to penetrate the upper base body and the lower base body at positions of the upper base body and the lower base body that are respectively adjacent to the rear ends of the upper base body and the lower base body, and comprising:

a releasing post having a post diameter matching a groove width of a remaining portion of a locking groove of the blade that excludes a portion at or adjacent to an open end of the locking groove, and having one end configured to be exposed from the other side of the connecting base; and a locking post having one end connected to the other end of the releasing post along an axial direction of the lock-release post and the other end concavely provided with a positioning groove extending in the axial direction of the lock-release post, having a post diameter matching a hole diameter of a locking hole of the blade and greater than the groove width of the remaining portion of the locking groove of the blade, and configured to be extended through the locking hole but not the remaining portion of the locking groove, and slide in the slide groove along the axial direction of the positioning sleeve;

an elastic element having one end configured to press against an inner surface of the other end of the positioning sleeve through the slide groove and the other end configured to be positioned at and press against an inner surface of the positioning groove to allow the locking post to slide in the slide groove along the axial direction of the positioning sleeve; and a lock-release button configured to be fixed at the one end of the releasing post and configured to be released by a user to displace the locking post to a position corresponding to the locking hole to bring the blade inserted into and engaged with the engaged-connection groove into a locked state in which the blade is securely positioned and undetachable, and be pressed by a user to displace the releasing post to the position corresponding to the locking hole to bring the blade inserted into and engaged with the engaged-connection groove into an unlocked state in which the blade is detachable, and to bring the connecting base into a blade-mountable state when the blade is not mounted to the connecting base, wherein the locking post is configured to, in the unlocked state, be displaced away from the locking groove and allow the blade to be detached from the connecting base, and in the blade-mountable state, be engaged with the locking groove.

7. The connecting base according to claim 6, further comprising:

at least one engaging post configured to lock together the upper base body and the lower base body; and at least one engaging portion formed, and extending forward from, at or adjacent to a front end of the spacer plate and having a configuration matching a configuration of a corresponding engaging groove of the blade, wherein each of the engaging portion and the engaging post is configured to be engaged with and connected to the engaging groove in response to the rear end of the blade or the portion of the blade that is adjacent to the rear end of the blade being inserted into and engaged with the engaged-connection groove.

8. The connecting base according to claim 6, wherein the blade is a saw blade or a tool plate configured to cut an object, and formed with a blade tip at a front end thereof and, along a longitudinal direction of the blade, at least one engaging groove and a locking groove that are adjacent to or at a rear end thereof, each of the engaging groove and the locking groove is elongated in shape, has an open end and a closed end, and has a first groove width at a portion thereof adjacent to or at the open end that is greater than or equal to a second groove width of a remaining portion thereof, the closed end of the locking groove is formed with a locking hole communicating with the locking groove, and a hole diameter of the locking hole is greater than the second groove width of the locking groove.

9. The connecting base according to claim 6, wherein a portion of the connecting base that is adjacent to or at the rear end of the connecting base is integrally formed with, fixedly connected to, or pivotally connected to a portion of the handle that is adjacent to or at a front end of the handle.

10. The connecting base according to claim 6, wherein the handle comprises an upper handle portion and a lower handle portion that collectively form a receiving space therebetween when assembled with each other, and the receiving space matches the blade in configuration and is configured to receive the blade therein.

11. The connecting base according to claim 6, wherein the rear end of the connecting base is pivotally connected to a front end of the handle, and the connecting base and the blade inserted into and engaged with the connecting base are rotatable relative to the handle and rotatable to be stored in a receiving space of the handle and to be spun out of the handle.

* * * * *